US005398480A

United States Patent [19]

Bankuty

[11] Patent Number: 5,398,480

[45] Date of Patent: Mar. 21, 1995

[54] DEVICE FOR STABILIZING CAPS WHILE BEING ATTACHED TO CONTAINERS

[75] Inventor: Geza E. Bankuty, Bradenton, Fla.

[73] Assignee: New England Machinery, Inc.

[21] Appl. No.: 266,018

[22] Filed: Jun. 27, 1994

[51] Int. Cl.[6] ..... B67B 3/20; B65B 7/28

[52] U.S. Cl. ..... 53/315

[58] Field of Search ..... 53/315, 314, 313, 317, 53/331.5

[56] References Cited

U.S. PATENT DOCUMENTS

| | | | |
|---|---|---|---|
| 2,876,605 | 3/1959 | McElroy et al. | 53/315 |
| 2,996,865 | 8/1961 | Hohl et al. | 53/315 |
| 3,012,388 | 12/1961 | Stover | 53/315 |
| 3,071,909 | 1/1963 | Elleman | 53/315 |
| 3,280,534 | 10/1966 | Hildebrandt et al. | 53/315 |
| 3,477,202 | 11/1969 | Zetterberg | 53/315 |
| 3,874,147 | 4/1975 | Zetterberg | 53/315 X |
| 4,199,914 | 4/1980 | Ochs et al. | 53/315 X |

*Primary Examiner*—Horace M. Culver
*Attorney, Agent, or Firm*—Pettis & McDonald

[57] ABSTRACT

A device for stabilizing container caps on the open ends of containers so that they may be securely threaded onto the containers by a capping machine. The device comprises a mounting means adapted for attachment to capping machines and a cap guide that comprises a base that is pivotally connected to the mounting means for rotation about one end of the base and has a biasing means interposed between the base and the mounting means that urges the cap guide into a downward position. The top of the cap engages the base rotating the cap guide to a generally horizontal position leveling the cap. Simultaneously the biasing means applies a downward force on the top of the cap to ensure that the threads on the cap will engage with those on the container when the cap is rotated.

9 Claims, 4 Drawing Sheets

DEVICE FOR STABILIZING CAPS WHILE BEING ATTACHED TO CONTAINERS

BACKGROUND OF THE INVENTION

1. Field of the Invention

The present invention relates to container capping machines. The invention is particularly directed to a device for stabilizing container caps on their corresponding containers during installation of the caps by capping machines.

2. Description of the Prior Art

Capping machines, that use rotating rollers to threadably cap containers, have been in existence for over 40 years. The current method of capping containers may be seen in the applicant's in-line capping machine Model No. NEIL-C 46-16. This capping machine, as well as other similar machines, operates by advancing containers along a predetermined path while gripping the container to prevent its rotation. The open top of the container engages and strips a cap from a standard cap dispensing apparatus. When coming to rest on the container, the cap is frequently misaligned, for example, tilted to one side.

Two driven rollers are placed in a predetermined fixed position on opposing sides of the predetermined path of the container so that each roller simultaneously engages the container cap as the container passes between the driven rollers. These rollers rotate the cap causing threads on the cap to engage threads on the container. Rotation of a misaligned cap may not always cause the cap to straighten, resulting in the threads on the cap becoming cross threaded with the threads on the container. Also, if the cap is not properly seated upon the container prior to rotation of the cap by the rollers, the rollers may rotate the cap without immediate engagement of the cap threads with the container threads. This delay in engagement may result in a cap that is not tightly closed after passing between the last pair of cap tightening rollers, creating a defective product. When the container caps must be tighten to a predetermined torque, cross threading will create incorrect readings, indicating that the proper torque has been reached and proper closure obtained. This may occur even when multiple pairs of rollers are used. Adding additional rollers, to ensure closure has occurred, adds time and cost to the bottling process. While additional rollers may solve the problem of the delayed engagement of the threads at additional cost, they will not solve the cross threading problem. There is a need, therefore, for a device that ensures that the container cap is placed on the container so that it is square to the open end of the container and provides a slight downward pressure on the cap to ensure that the cap threads threadably engage the container threads as quickly as possible, improving the efficiency of the capping process and reducing the number of failures.

SUMMARY OF THE INVENTION

The present invention is related to a device for stabilizing container caps on the open ends of containers so that the caps may be securely threaded onto the containers by a capping machine. The device comprises a mounting means adapted for mounting the cap stabilizing device to a capping machine and a cap guide for engaging a container cap.

The cap guide comprises a base having a first end and a second end. The cap guide is pivotally connected to the mounting means intermediate the first and second ends of the base. The second end of the base is pivoted about a generally horizontal axis that passes through the pivot point. The second end of the base rotates through a predetermined angle of rotation, between a generally horizontal position and a downward position.

A biasing means is interposed between the mounting means and the cap guide urging the cap guide toward the downward position. Thus, after a cap is captured on the open end of a container it passes beneath the base of the cap guide so that the top surface of the cap engages the base of the cap guide. Engagement of a cap with the base causes the second end of the base of the cap guide to rotate to the horizontal position, as the container advances, squaring the top surface of the cap with the open end of the container. As the cap guide rotates between the downward position and the horizontal position, a downward force is applied by the biasing means to the top surface of the cap forcing the cap downwardly on the open end of the container. This downward force ensures that the threads of the cap align with the threads of the container so that when the rollers engage the cap, the threads of the cap quickly engage the threads of the container and the cap is quickly threaded squarely onto the open end of the container.

BRIEF DESCRIPTION OF THE DRAWINGS

A preferred embodiment of the device of this invention will be disclosed in detail below in connection with the drawings in which.

Similar reference characters refer to similar parts throughout the several views of the drawings.

DETAILED DESCRIPTION

Figure 1:
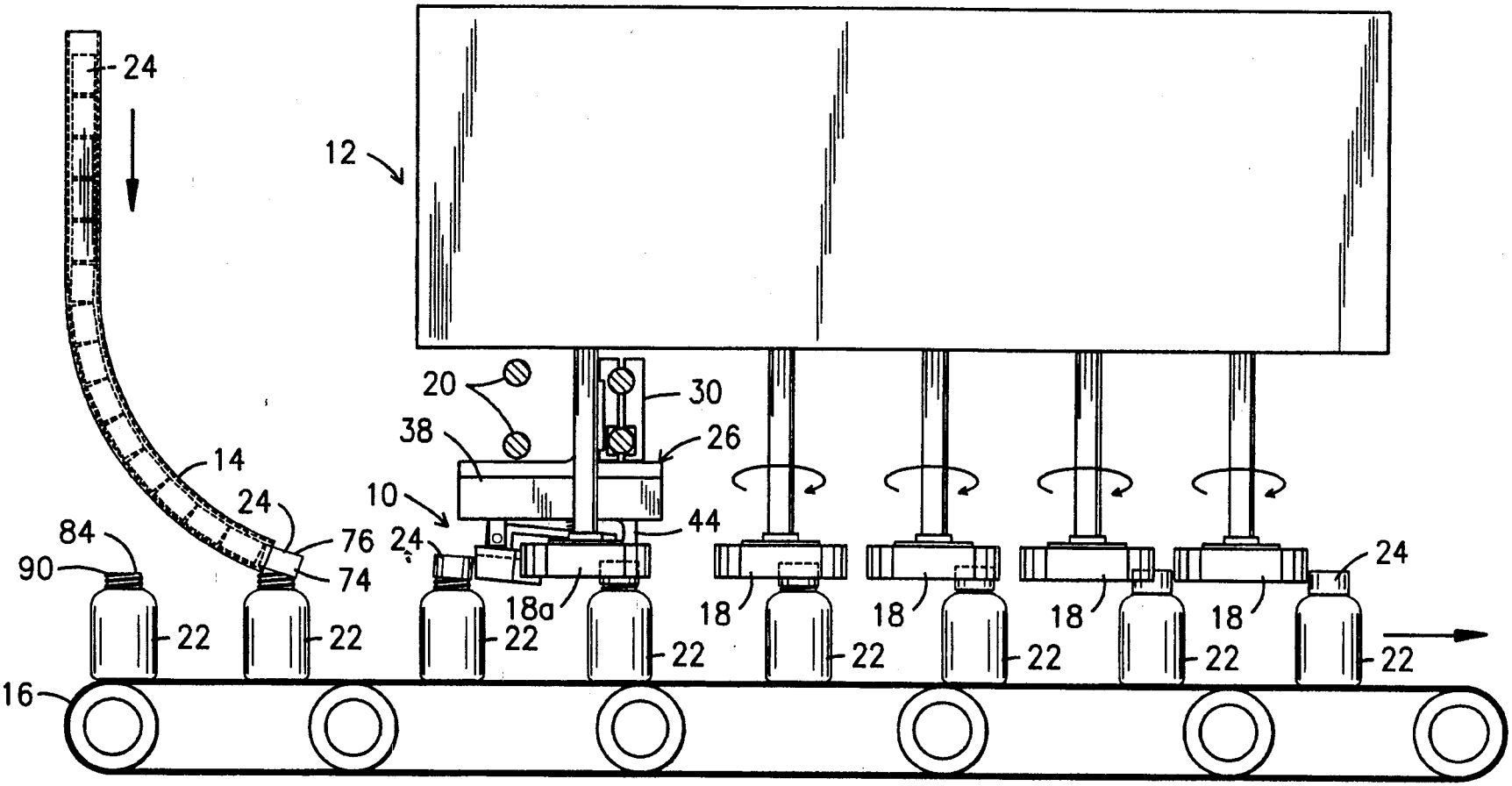
FIG. 1 is a front elevational view of one embodiment of the device of this invention illustrating its relationship to an in-line capping machine.
Figure 2:
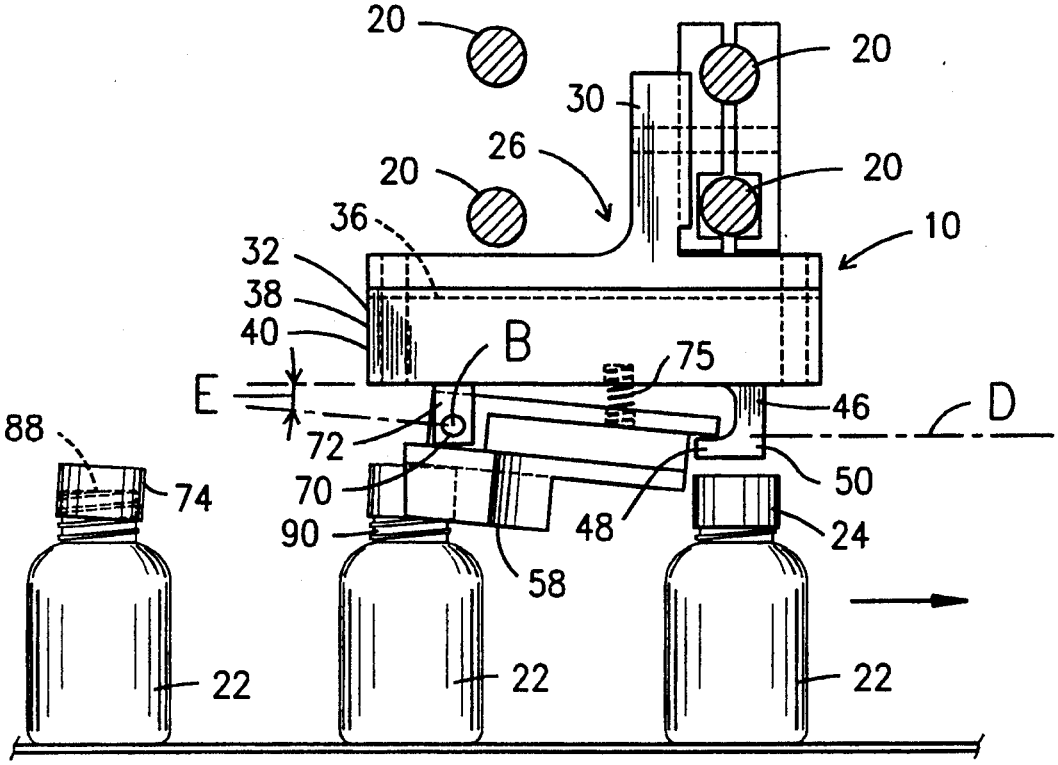
FIG. 2 is a front elevational view of the device of FIG. 1 shown in larger scale, illustrating the cap guide in the downward position.
Figure 3:
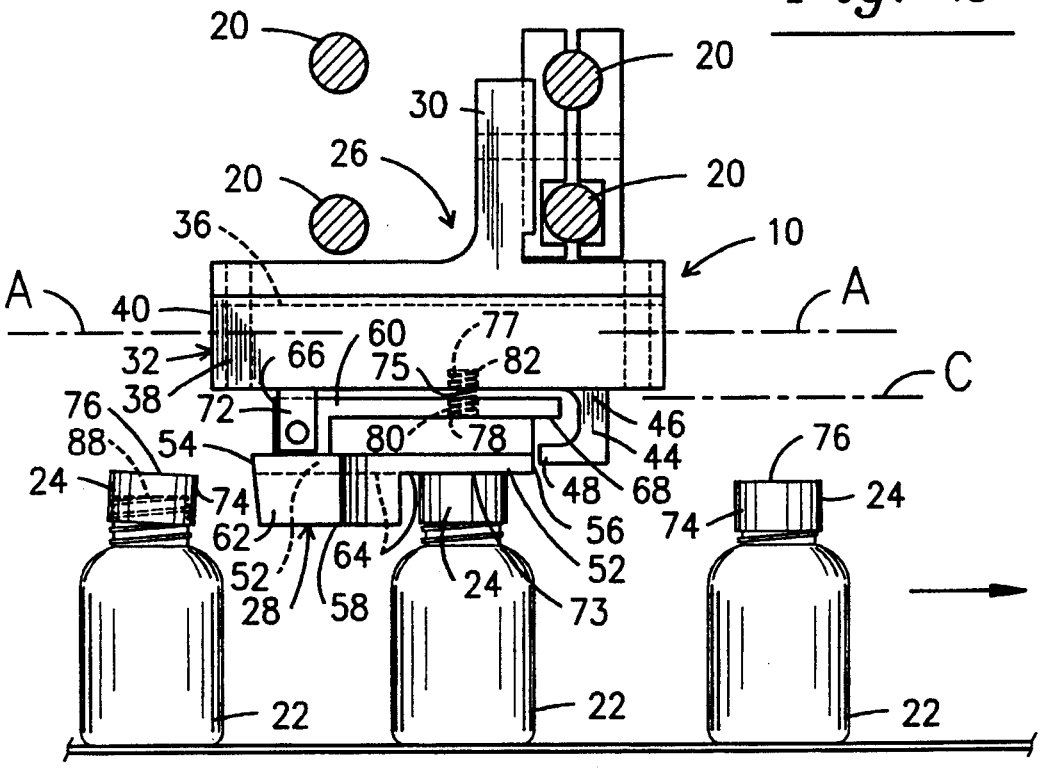
FIG. 3 is a front elevational view similar to FIG. 2 but illustrating the cap guide in the horizontal position.
Figure 5:
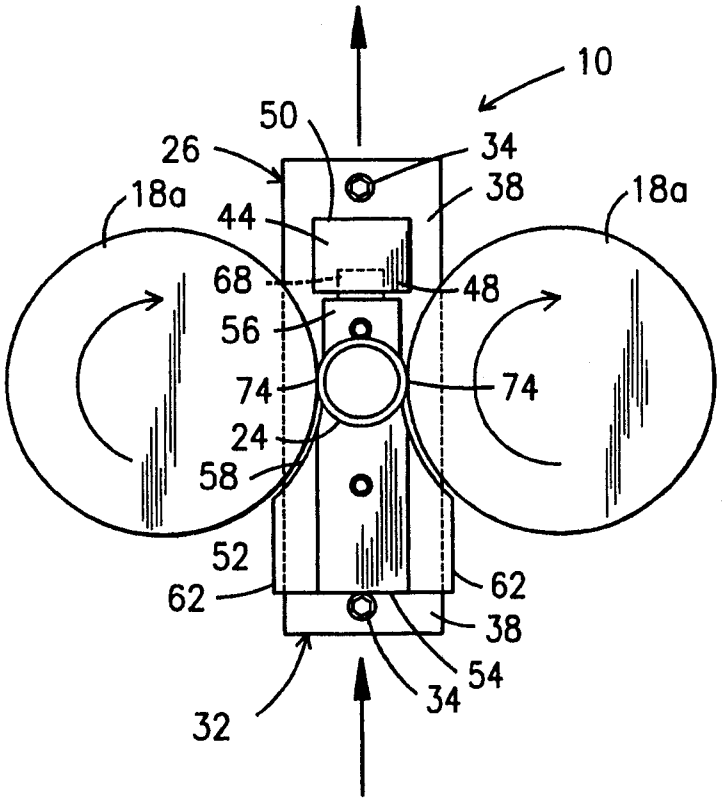
FIG. 5 is a bottom plan view of the device taken along line 5—5 of FIG. 4.
Figure 4:
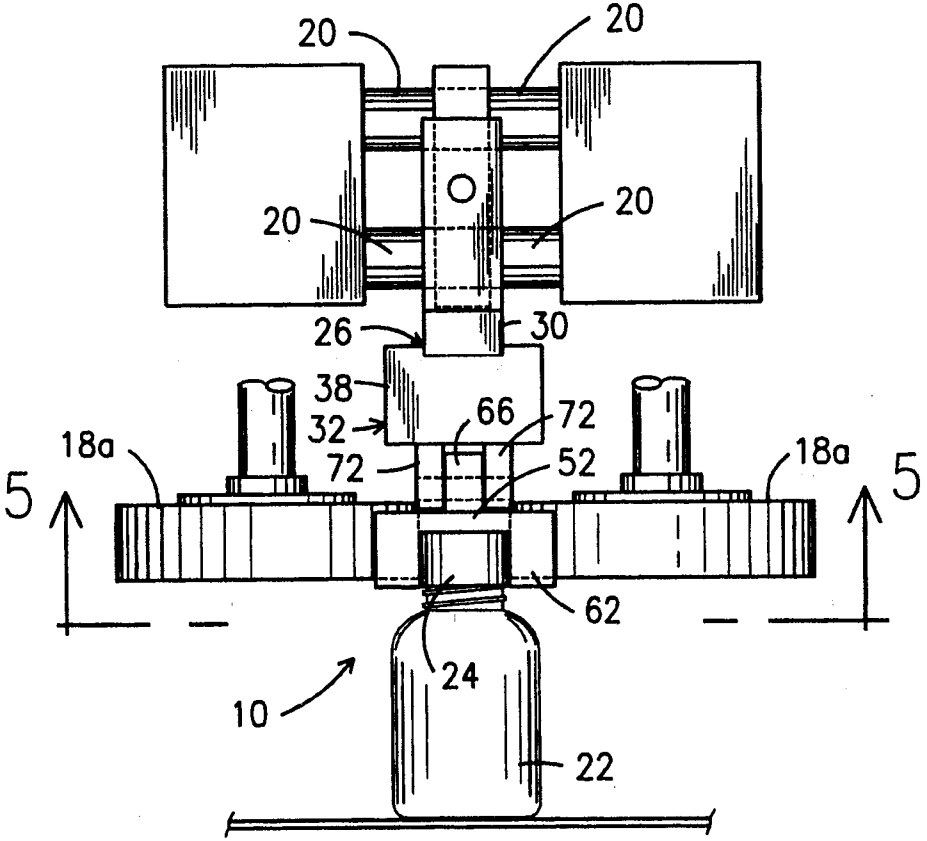
FIG. 4 is a left side elevational view of the invention of FIG. 3.
Figure 6:
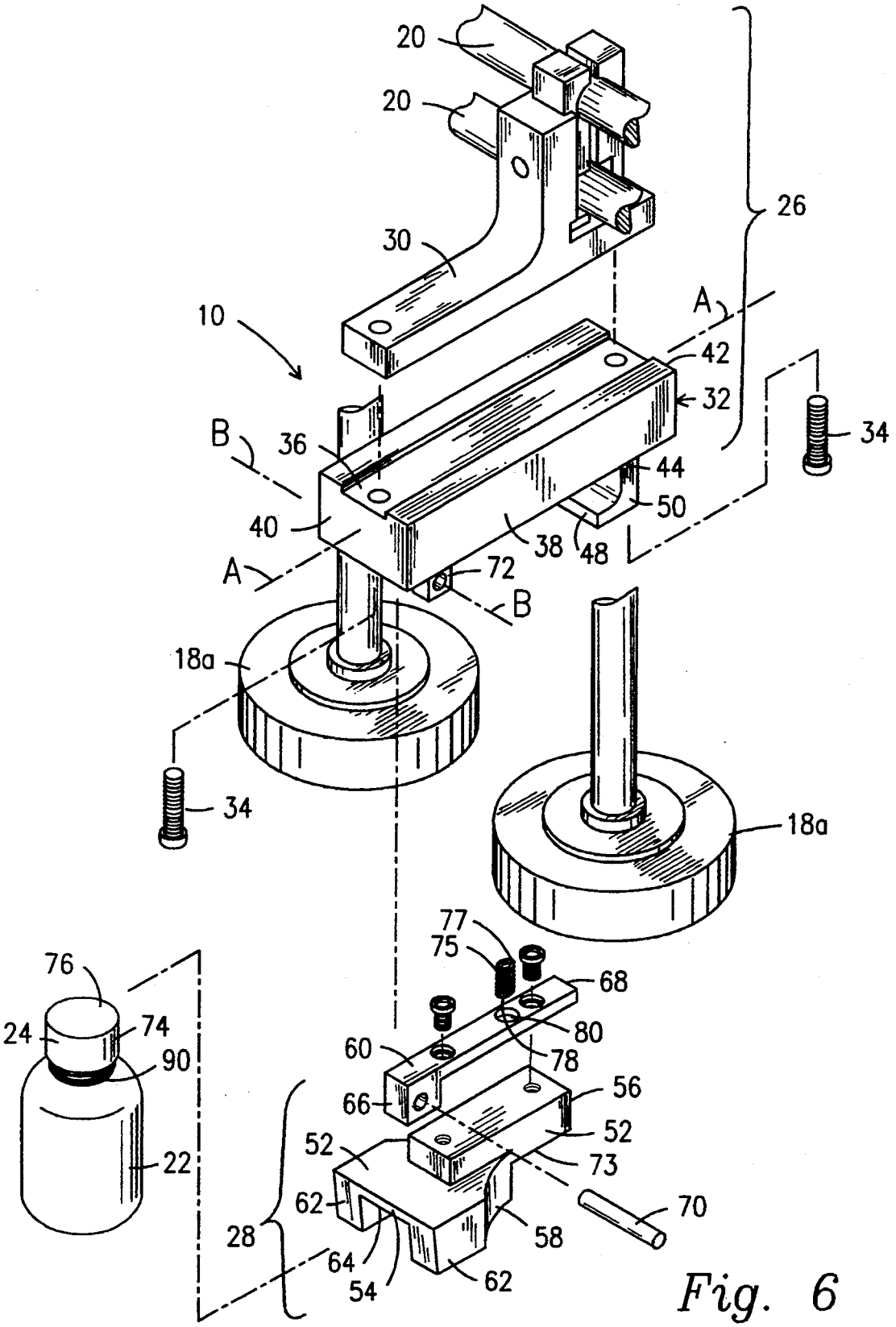
FIG. 6 is a detailed exploded perspective view of the device of FIG. 4 of this invention.

A preferred embodiment for the cap stabilizing device of this invention is indicated as 10 in the drawing FIGS. 1–6. FIG. 1, illustrates the relationship of the device 10 with a capping machine, generally indicated as 12, a cap dispenser 14, and a conveyor 16. Portions of the capping machine 12 are also illustrated in FIGS. 4 through 6, in particular, a pair of driven rollers 18 and a support frame 20. As seen in FIG. 1, capping machines may have a plurality of rollers 18; however the first pair of rollers will be designated 18*a*. In FIG. 1, a plurality of containers 22 are illustrated, most having a cap 24 placed thereon.

The device 10, as most clearly shown in FIG. 6, is comprised of a mounting means, shown generally as 26, and a cap guide, shown generally as 28. The mounting means is comprised of a mounting block 30 that, in this embodiment, is adapted for attachment to the applicant's in-line capping machine, Model No. NEIL-C 46-16. The mounting block 30 is designed to be attached to the frame 20 adjacent to the first pair of rollers 18a. In other embodiments, the mounting block 30 may be fabricated by conventional means for attachment to the frame of any capping machine for which the device would be suitable.

A clevis block, generally indicated as 32, is attached to the mounting block 30 by conventional means, in this embodiment by bolts 34, so that the mounting block 30 may be easily removed from the clevis block 32 for attachment of different embodiments of the mounting block 30. As shown in FIG. 6, a groove 36 is formed in the clevis block 32 to receive the mounting block 30 therein for added stability. The clevis block 32 further comprises a plate 38 that has an axis A extending longitudinally therethrough and a first end 40 and a second end 42. The clevis block 32 further comprises an arm 44 having a first end 46 and a second end 48. The first end 46 of the arm 44 can be seen more clearly in FIGS. 2 and 3 where it can be seen attached to the plate 38. The arm 44 has a bend 50 intermediate the first end 46 and the second end 48. Because of this bend 50, the second end 48 of the arm 44 extends toward the first end 40 of the plate 38 and is spaced apart from the plate 38.

The cap guide 28 is pivotally connected to the mounting means 26 for rotation about a generally horizontal axis B so that the cap guide 28 moves between a generally horizontal position C, as shown in FIG. 3, and a downward position D, as shown in FIG. 2. The angular rotation between positions C and D comprises a predetermined angle of rotation E. The angle of rotation E is sized to ensure that the first end of the plate rotates sufficiently in the upward direction to receive a cap 24 under the cap guide 28, even when the cap 24 is not fully seated on the container 22.

As shown in FIG. 6, the cap guide 28 comprises a base 52, which has a first end 54 and a second end 56, and a pivot block 60. The cap guide 28 further comprises a pair of lateral guide means 62 that extend downwardly from the base 52 of the cap guide 28. The lateral guide means 62 are spaced apart from one another so that a cap 24 may be received therebetween. The spacing between the lateral guide means 62 is sufficiently close to ensure that the cap 24 remains generally vertical as the cap 24 engages the bottom surface 64 of the base 52 and moves longitudinally with respect to the base 52 and the longitudinal axis A of the mounting block 38. In the preferred embodiment, the lateral guide means 62 is formed integrally with the base 52, however in other embodiments the lateral guide means may be attached separately to the base 52 or even spaced apart therefrom or attached to the clevis block 32. Attaching the lateral guide means 62 directly to the base 52 permits easy replacement of the guide means 28 with guide means of different sizes so that different sized caps 24 will fit between the lateral guide means 62. By attaching the lateral guide means 62 to the clevis block 32, the lateral guide means 62 would have to be made adjustable in order to accept caps 24 of different sizes.

The pivot block 60, having a first end 66 and a second end 68, is removably attachable, by conventional means, to the base 52 of the cap guide 28. The first end 66 of the pivot block 60 is pivotally attached to the clevis block 32 proximal to the first end 40 of the plate 38 of the clevis block 32. In this embodiment, the pivot block 60 is hingedly pinned by pin 70 to two supports 72 that project downwardly from the second end 42 of the plate 38. Any conventional method for pivotal attachment of the pivot block 60 to the plate 38 may be used, as the method illustrated is but one embodiment of well known pivoting means. The pivot block 60 is so sized and configured that the second end 68 is received between the second end 48 of the arm 44 and the plate 38. Therefore, the second end of the pivot block 68 is permitted to rotate through a predetermined angle of rotation E between the plate 38 and the second end 48 of arm 44.

In the preferred embodiment, the lateral guide means 62 extends downwardly from only a portion of the base 52 leaving the remainder of the base 52 as a planar portion 73. The planar portion 73 of the base 52 is the portion of the cap guide 28 that extends between the rollers 18*a*. In this embodiment, a curved portion of each of the lateral guide means 62 is removed leaving a curved portion 58 as shown in FIG. 6 so that the rollers may fit snugly adjacent to the cap guide 28. This permits the generally opposing rollers 18*a* to engage the side 74 of the cap 24 as it moves along the planar portion 73 of the cap guide 28.

A biasing means, conveniently spring 75, is interposed between the mounting means 26 and the cap guide 28 so that the cap guide 28 is biased toward the downward position D and applies a downward force to the top 76 of the container cap 24 when the container cap 24 engages the cap guide 28. The spring 75 has a first end 77 that engages the plate 38 and a second end 78 that engages the pivot block 60. In this embodiment, the pivot block 60 and the plate 38 each have a hole, 80 and 82 respectively, bored partway therethrough to receive a respective end of the spring 75. In other embodiments, other biasing means suitable for the purpose may be used, including but not limited to leaf springs and resilient materials.

Having thus set forth a preferred construction for the stabilizing device 10 of this invention, it is to be remembered that this is but a preferred embodiment. Attention is now invited to a description of the use of the device 10. The device 10 is attached by its mounting means 26 to the frame 20 of the capping machine 12 so that the planar portion 73 of the base 52 is inserted between the first pair of opposing rollers 18*a*, as shown clearly in FIGS. 4 and 5.

As shown in FIG. 1 a container 22 is moved along the conveyor 16 so that the open end 84 engages a cap 24 stripping it from the cap dispenser 14. The cap 24 may rest at an angle on the container 22. As the conveyor 16 moves the container 22 toward the rollers 18, the cap 24 engages the bottom surface 64 of the base 52 of the cap guide 28 as shown in FIG. 2. FIG. 2 illustrates the cap guide 28 in the downward position D. As the hinge supports 72 are intermediate the first end 54 and the second end 56 of the base 52, the first end 54 of the base is angled slightly upwardly to receive the cap 24 adjacent to the bottom surface 64 of the base 52.

As the container continues to move forward the top surface 76 of the cap 24 engages the bottom surface 64 of the base 52. The lateral guide means 62 maintains the cap 24 in an upright position as the base 52 forces the cap 24 downwardly on the threaded open end 84 of the container 22. As the container advances, the cap 24 pushes the base 52 into the horizontal position, causing the spring 75 to apply a downward force on the pivot block 60 and thus on the base 52 and to the top surface 76 of the cap 24. The rotating rollers 18*a* turn the cap 24 in a clockwise direction. The force applied by the cap guide 28 to the cap 24 ensures quick engagement of the threads 88 of the cap 24 with the threads 90 of the container 22. The downward force, the lateral guide means 62 and the horizontal alignment of the base 52 all ensure that the cap 24 is threaded upon the container 22 properly. The arm 44 prevents the cap guide 28 from rotating beyond the predetermined angle E, so that the cap 24 can be easily received by the cap guide 28.

After the rollers 18*a* have rotated the cap 24 so that the threads 88 and 90 have been engaged, the container 22 advances to the next set of rollers for further tightening. The cap guide 28 then rotates to the downward position D so that it is ready to receive the cap 24 of the next container 22.

While the foregoing description is directed to particularly preferred embodiments of the present invention, it is to be understood that these embodiments are representative only of the principles of the invention and are not to be considered limitative thereof. Because numerous variations and modifications of the device, are all within the scope of the present invention, it will become apparent to those skilled in the art, that the scope of the invention is to limited solely by the claims dependent hereto.

Now that the invention has been described,

What is claimed is:

1. A cap stabilizing device adapted for use in conjunction with a container capping apparatus having at least one pair of generally opposed cap tightening rollers for rotatably engaging the side of threaded container caps, the downwardly facing container caps having a top surface and at least one side, said cap stabilizing device comprising:

mounting means adapted for mounting said cap stabilizing device to the capping apparatus;

a cap guide comprising a base adapted for engaging a container cap, said base having a first end and a second end, said cap guide being pivotally connected, intermediate said first end and said second end of said base, to said mounting means for rotation of said second end of said base about a generally horizontal axis between a generally horizontal position and a downward position, said downward position of said base comprising a predetermined angle of rotation about said generally horizontal axis; and means interposed between said mounting means and said cap guide for biasing said cap guide toward said downward position, whereby a downward force is applied to a container cap when the container cap engages said cap guide.

2. A device as in claim 1 wherein said cap guide further comprises lateral guide means extending downwardly from at least a portion of said base, said lateral guide means being spaced apart such that said cap guide is adapted to receive the container cap between said lateral guide means.

3. A device as in claim 2 wherein said lateral guide means is formed integrally with said base of said cap guide.

4. A device as in claim 1 wherein said base of said cap guide further comprises a planar portion including said second end of said base, said planar portion being sized and configured to be received between the pair of cap tightening rollers, whereby when said planar portion of said cap guide engages a container cap the rollers engage the side of the container cap.

5. A device as in claim 1 further comprising a means for limiting said rotation of said cap guide to a predetermined maximum angle of rotation.

6. A device as in claim 1 wherein said mounting means further comprises a mounting block adapted for attachment to the capping apparatus and a clevis block attached to said mounting block, said clevis block comprising a plate having a first and a second end and said clevis block having a longitudinal axis that lies in a generally horizontal plane, said cap guide being pivotally attached to said first end of said plate for said rotation of said second end of said base; and means for limiting said rotation of said cap guide being attached to said second end of said plate and engaging said cap guide.

7. A device as in claim 6 wherein said means for limiting said rotation of said cap guide comprises an arm having a first end and a second end, said first end being attached to said plate and said second end extending downwardly therefrom, said arm having a bend intermediate said first end and said second end such that said second end of said arm is spaced apart from said plate and extends toward said first end of said plate such that a portion of said cap guide engages said second end of said arm when said cap guide is in said downward position, whereby said rotation of said cap guide is limited.

8. A device as in claim 7 wherein said cap guide further comprises a pivot block having first and second ends, said pivot block being attached to said base such that said second end of said pivot block extends beyond said second end of said base, said second end of said pivot block being received between said second end of said arm and said plate of said clevis block, whereby when said cap guide rotates to said downward position said second end of said pivot block engages said second end of said arm.

9. A device as in claim 8 wherein said biasing means is interposed between said clevis block and said pivot block.

* * * * *